US006896582B2

(12) United States Patent
Kawami

(10) Patent No.: US 6,896,582 B2
(45) Date of Patent: May 24, 2005

(54) CLOTHING FOR WOMAN

(75) Inventor: Fumiko Kawami, Osaka (JP)

(73) Assignee: With Kabushiki Kaisha, Osaka (JP)

( * ) Notice: Subject to any disclaimer, the term of this patent is extended or adjusted under 35 U.S.C. 154(b) by 190 days.

(21) Appl. No.: 10/257,982

(22) PCT Filed: Dec. 20, 2000

(86) PCT No.: PCT/JP00/09012

§ 371 (c)(1),
(2), (4) Date: Oct. 29, 2002

(87) PCT Pub. No.: WO02/49464

PCT Pub. Date: Jun. 27, 2002

(65) Prior Publication Data

US 2003/0104759 A1 Jun. 5, 2003

(51) Int. Cl.[7] ..... A41C 3/00
(52) U.S. Cl. ..... 450/86; 450/64
(58) Field of Search ..... 450/1, 64, 71, 450/72, 85, 86, 88, 87, 79, 59, 60–63, 6–8, 17, 26–29, 68, 39–42, 44; D2/706–709, 721, 731, 736, 737; 2/73, 67, 69, 78.1–78.4

(56) References Cited

U.S. PATENT DOCUMENTS 1,923,821 A * 8/1933 Gudeman ..... 450/85
2,202,058 A * 5/1940 Malnick ..... 450/59
2,535,018 A * 12/1950 Reid ..... 2/67
2,542,881 A * 2/1951 Ries ..... 450/59
2,679,646 A * 6/1954 Cousins ..... 450/39
3,027,898 A * 4/1962 Williams ..... 450/86
3,071,140 A * 1/1963 Adler ..... 450/86
3,459,190 A * 8/1969 Frischer et al. ..... 450/59
3,465,754 A * 9/1969 Lockwood et al. ..... 450/1
3,982,547 A * 9/1976 Walker ..... 450/28

FOREIGN PATENT DOCUMENTS

| | | |
|---|---|---|
| FR | 781 297 A | 5/1935 |
| GB | 618 841 A | 2/1949 |
| JP | 53-54224 | 5/1978 |
| JP | 62-20403 | 5/1987 |
| JP | 11-256404 | 9/1999 |

* cited by examiner

*Primary Examiner*—Gloria M. Hale
(74) *Attorney, Agent, or Firm*—Armstrong, Kratz, Quintos, Hanson & Brooks, LLP

(57) ABSTRACT

A ladies garment is composed of left and right cups 1, 2, and stretchable first and second tapes 5, 6 which are attached to a left side part 1*a* of the left cup 1 and a right side part 2*a* of the right cup 2 and which are put on in such a manner as to wrap the body from each side and across the back. The first tape 5 is attached to a top end 1*b* of the side part 1*a* of the first cup 1 and to a bottom end 2*c* of the side part 2*a* of the second cup 2. The second tape 6 is attached to a bottom end 1*c* of the side part 1*a* of the first cup 1 and to a top end 2*b* of the side part 2*a* of the second cup 2. The first tape 5 and the second tape 6 are arranged to cross over each other at the center of the back.

3 Claims, 5 Drawing Sheets

CLOTHING FOR WOMAN

TECHNICAL FIELD

The present invention relates to a ladies garment composed of left and right cups, and tapes which are attached to a left rim of the left cup and a right rim of the right cup and which are to be put on in such a manner as to wrap the body from each side and across the back. More specifically, the present invention relates to a ladies garment, particularly a brassiere, which remains fitted on the body (torso) without sliding off the position even when a wearer raises and lowers her arms.

BACKGROUND ART

The structure of a conventional brassiere is illustrated in FIGS. 5(*a*) and (*b*).

Specifically, a conventional brassiere has left and right cups 81, 82, and a left panel 83 and a right panel 84 which are sewn to the left and right cups 81, 82. Hooks and eyes 85*a*, 85*b* are provided at an end 83*a* of the left panel 83 and an end 84*a* of the right panel 84, respectively.

The left panel 83 and the right panel 84 are made of a material which is stretchable mainly in sidewise directions. In addition, elastic tapes 86, 87 are sewn respectively on the left panel 83 and the right panel 84 along their upper and lower edges.

Namely, regarding the conventional brassiere, the cups 81, 82 are respectively pulled in the directions shown in the figure by arrows X and Y, mainly by means of the elastic tapes 86, 87 which are sewn sidewise on the brassiere, so that the cups 81, 82 can remain fitted on the breasts.

Now, according to the human body structure, when a person moves her arms upwardly and downwardly or otherwise, muscles under the arms also stretch and contract upwardly and downwardly, as shown by arrow Z in FIG. 5(*b*).

In the case of the conventional brassiere, although it provides forces in the directions of arrows X, Y in FIG. 5(*b*), it generates no force which follows such vertical muscle movement. On the contrary, the lower tape 86 effects a horizontal force (the Y direction in FIG. 5(*b*)), and the upper tape 86 exerts an oblique downward force (the X direction in FIG. 5(*b*)). Hence, if the arms are raised and lowered repeatedly, the panels 83, 84 slide down in due course, causing the cups 81, 82 to slide down as well.

The present invention has been made in order to solve such problems. An object of the present invention is to provide a ladies garment in which cups and tapes remain fitted on the body without sliding off the position, even when a wearer moves her arms upwardly and downwardly or otherwise.

DISCLOSURE OF THE INVENTION

In order to solve the above problems, a ladies garment of the present invention is composed of left and right cups, and tapes which are attached to a left rim of the left cup and a right rim of the right cup and which are to be put on in such a manner as to wrap the body from each side and across the back, characterized in that the tapes comprise a stretchable first tape attached to an upper rim of the first cup and a lower rim of the second cup, and a stretchable second tape attached to a lower rim of the first cup and an upper rim of the second cup, with the first tape and the second tape being arranged to cross over each other at the center of the back.

According to the present invention having such features, stretching forces of the first tape and the second tape are exerted continuously from the left side of the body and across the back to the right side of the body. Besides, these forces cross obliquely at the center of the back and act with the same strength. Hence, when arms are raised and lowered, the present invention can flexibly cope with the vertical stretch and contraction at the sides of the body. To be specific, since the first tape and the second tape pull each other with equal forces, the garment can remain fitted on the body in a stable manner, without being affected by the vertical stretch and contraction at the sides of the body which results from the upward and downward movement of the arms.

Regarding the above structure, the ladies garment of the present invention is characterized in that the tapes extend along the upper rim and/or the lower rim of each cup and reach the center between the cups. By extending the tapes to the center between the cups, the stretching property of the tapes is exerted on the entire brassiere, thus ensuring a better fit on the body.

Regarding each of the above structures, the ladies garment of the present invention is characterized in that joints at the left and right cups are connected by stretchable third and fourth tapes, with the third tape and the fourth tape being arranged to cross over each other at the center of the breasts. In this case, the crossed arrangement of two stretchable tapes is adopted not only on the back side but also on the breast side. This arrangement maintains a balance of the stretching property on the back side and the breast side, thus allowing the garment to fit better on the body.

BRIEF DESCRIPTION OF THE DRAWINGS

FIG. 5(*a*) is a perspective view showing the structure of a prior art conventional brassiere, and FIG. 5(*b*) is a side view showing the state in which the brassiere is put on.

BEST MODE FOR CARRYING OUT THE INVENTION

Figure 1:
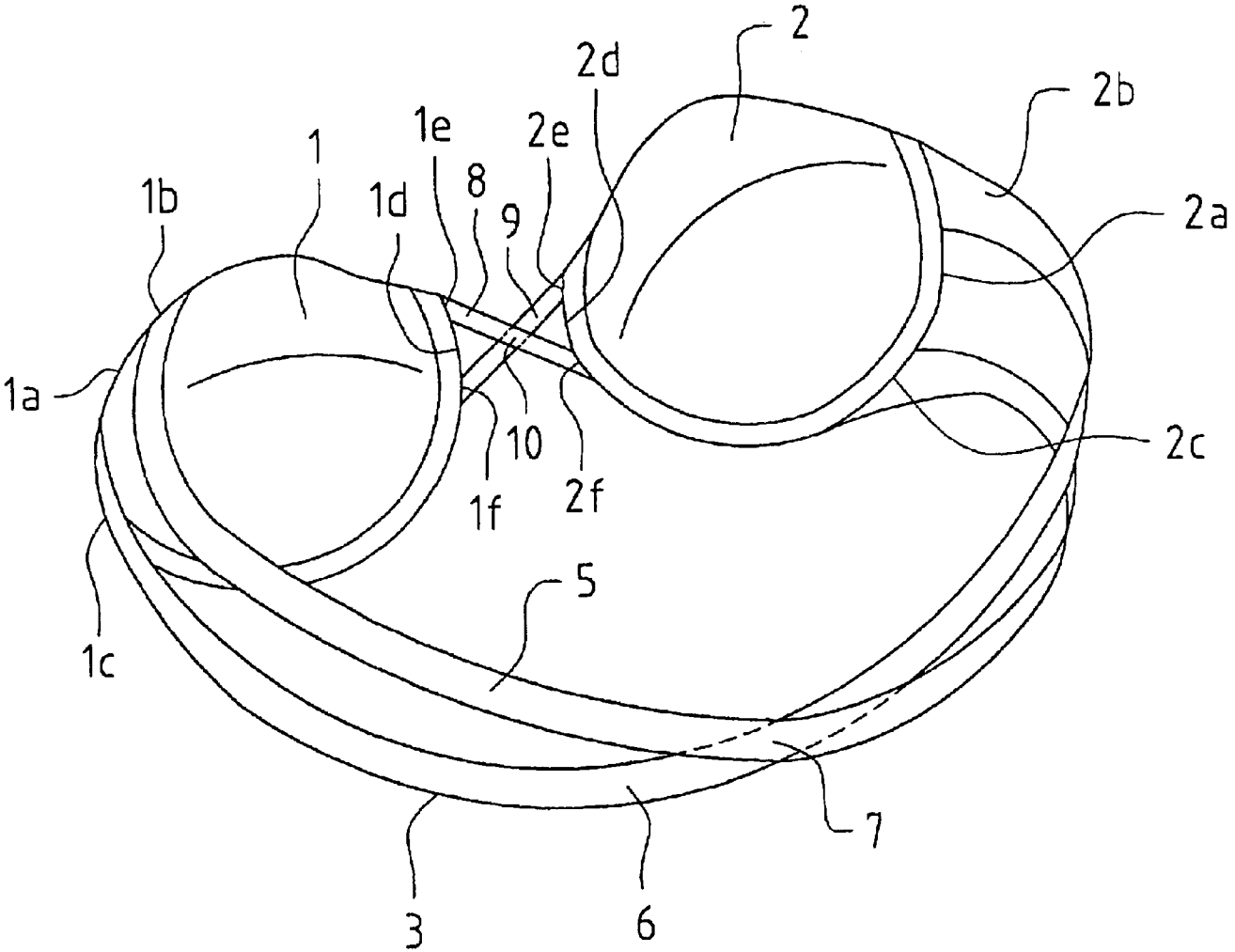
FIG. 1 is a perspective view showing the structure of a brassiere which is a ladies garment of the present invention.

Referring to the drawings, embodiments of the present invention are described below.

Figure 2:
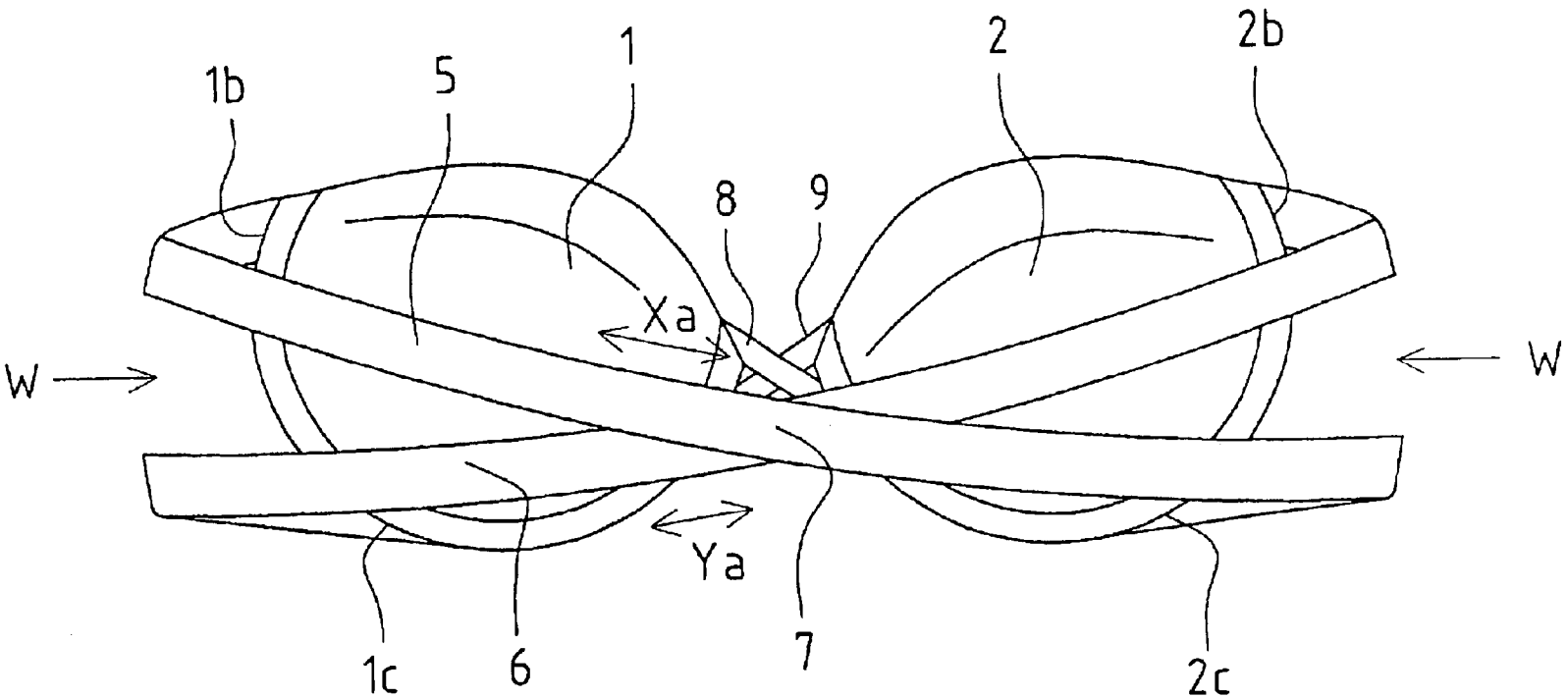
FIG. 2 is a rear view of the brassiere shown in FIG. 1.
Figure 3:
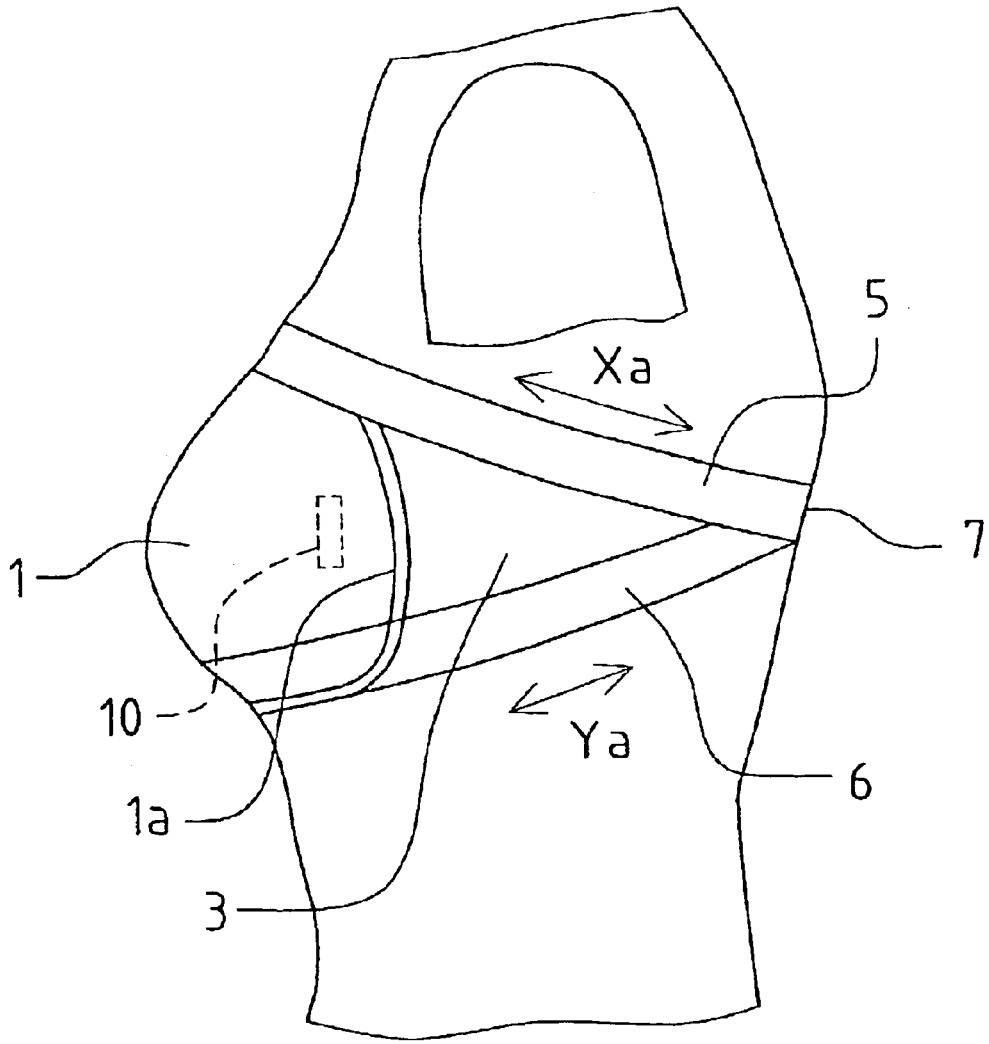
FIG. 3 is a side view showing the state in which the brassiere of FIG. 1 is put on the body.

FIG. 1 is a perspective view showing the structure of a brassiere which is a ladies garment of the present invention. FIG. 2 is a rear view thereof. FIG. 3 is a side view showing the state in which the brassiere is put on the body.

A brassiere of this embodiment is composed of left and right cups 1, 2, stretchable third and fourth tapes 8, 9 sewn to joints of the cups 1, 2, and first and second tapes 5, 6 which are sewn to a left rim and a right rim (side parts) 1*a*, 2*a* of the cups 1, 2 and which are to be put on in such a manner as to wrap the body from each side of the body and across the back.

Specifically speaking, the first tape 5 is connected to a top end 1*b* of the side part 1*a* of the first cup 1 (corresponding to an upper rim of the cup, as recited in the claims) and also connected to a bottom end 2*c* of the side part 2*a* of the second cup 2 (corresponding to a lower rim of the cup, as recited in the claims). The second tape 6 is connected to a bottom end 1*c* of the side part 1*a* of the first cup 1 (corresponding to a lower rim of the cup, as recited in the claims) and also connected to a top end 2*b* of the side part 2*a* of the second cup 2 (corresponding to an upper rim of the cup, as recited in the claims) As a result, the first and second tapes 5, 6 cross obliquely over each other at the center of the back.

Besides, the third tape 8 is connected to a top end le of the joint 1*d* of the first cup 1 and also connected to a bottom end 2*f* of the joint 2*d* of the second cup 2. The fourth tape 9 is connected to a bottom end 1*f* of the joint 1*d* of the first cup 1 and to a top end 2*e* of the joint 2*d* of the second cup 2. As a result, the third and fourth tapes 8, 9 also cross obliquely over each other at the center of the breasts.

Additionally, the first and second tapes 5, 6 and the third and fourth tapes 8, 9 may be sewn together at a cross point 7 and a cross point 10, respectively, in which case care should be taken not to sacrifice their lengthwise strechability. However, it is not always necessary to sew down the cross points 7, 10. If they are left unsewn, the stretching property of the first and second tapes 5, 6 and that of the third and fourth tapes 8, 9 function more effectively. At the same time, the stretching property at the front of the body (on the breast side) is balanced with the stretching property at the back of the body (on the back side) Hence, the resulting garment ensures a better fit on the body.

A brassiere of this structure is put on the body (the breasts) as shown in FIG. 3. In this state, the first tape 5 exerts a continuous force from the left side of the body through the center of the back to the right side of the body (not shown). Likewise, the second tape 6 exerts a continuous force from the left side of the body through the center of the back to the right side of the body (not shown). It should be noted that these forces cross obliquely at the center of the back. Hence, on the left side and the right side relative to the center of the back (on the left side and the right side in FIG. 2), vertical components of the forces Xa and Ya are cancelled by each other. As a whole, therefore, the first tape 5 and the second tape 6 serve to press the body in the horizontal directions (the directions of arrows W in FIG. 2).

When an arm is raised, muscles at the side of the body move upwardly and impose a force (an upward lifting force) on the brassiere. For example, referring to FIG. 3 showing the left side of the body, this upward lifting force is cancelled by an oblique downward pulling force exerted by the first tape 5. When an arm is lowered, muscles at the side of the body move downwardly and impose a force (a downward pulling force) on the brassiere. Again, referring to FIG. 3 showing the left side of the body, this downward pulling force is cancelled by an oblique upward lifting force exerted by the second tape 6.

Figure 4:
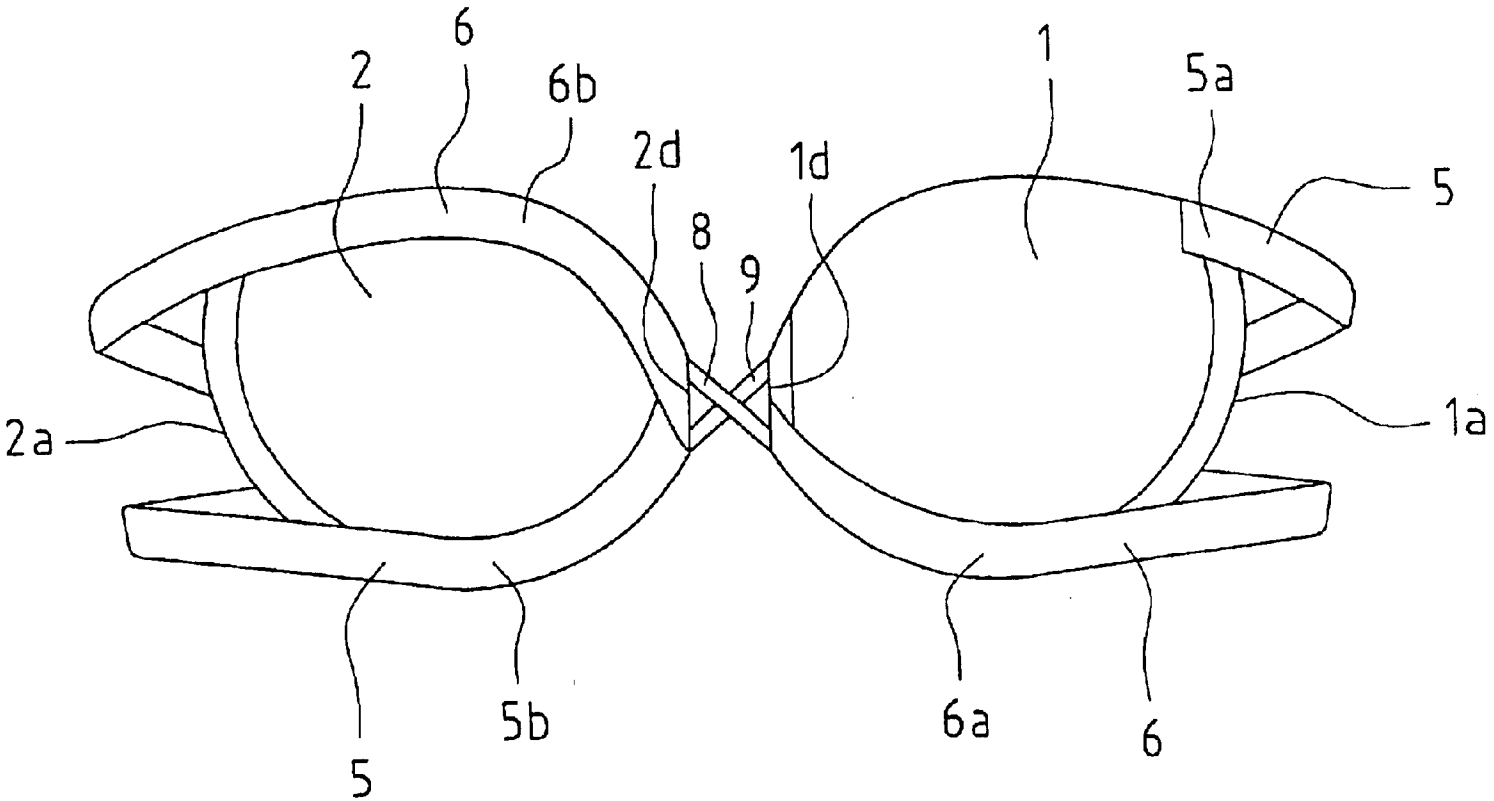
FIG. 4 is a front view showing other embodiments of a brassiere which is a ladies garment of the present invention.
Figure 5:
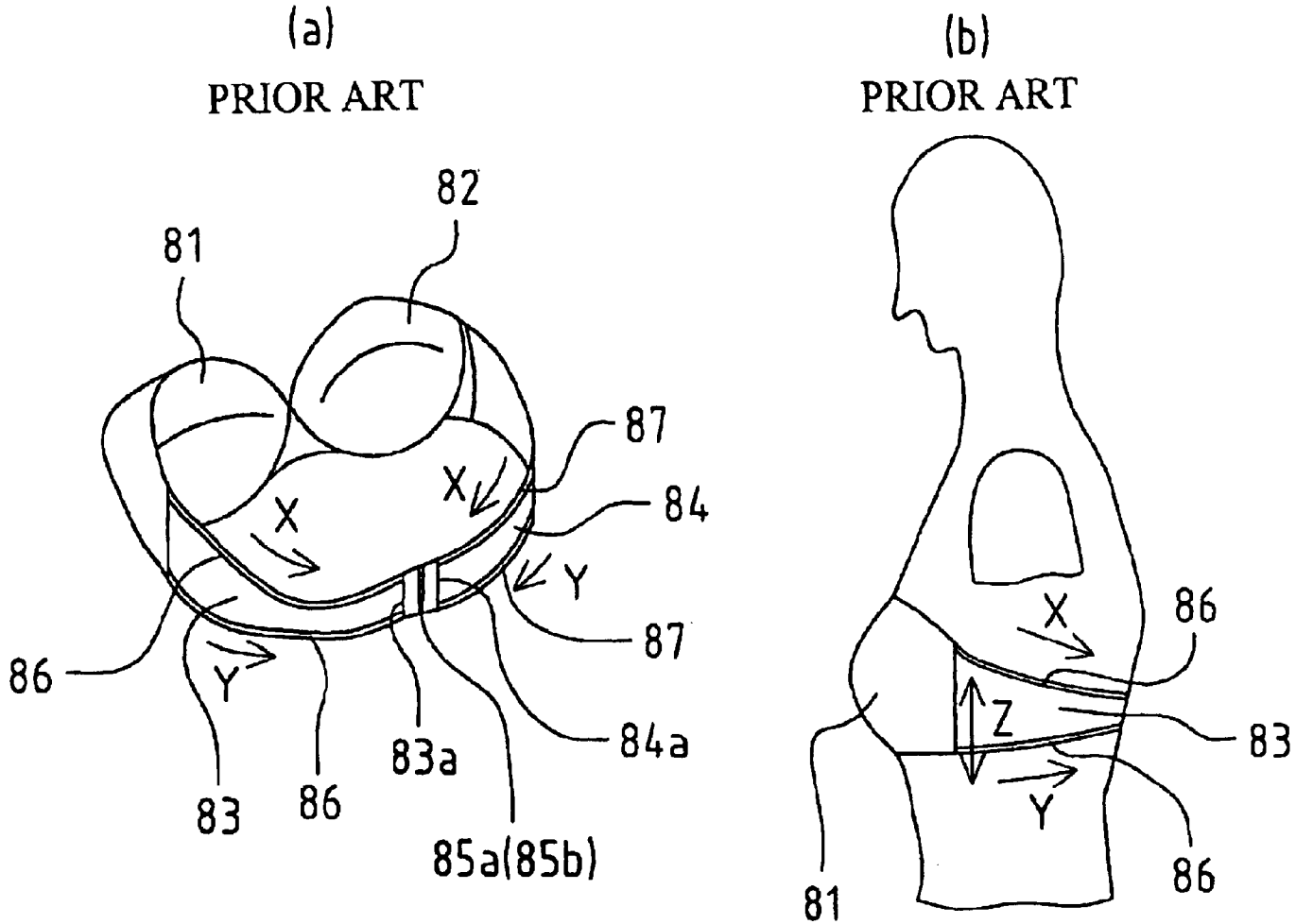

FIG. 4 is a front view showing other embodiments of the brassiere according to the present invention.

One of these embodiments is materialized in a cup 1. A sewn-down part 5*a* of the first tape 5 does not extend along the upper rim of the cup 1, while a sewn-down part 6*a* of the second tape 6 extends to the center (joint) 1*d* along the lower rim of the cup 1. Turning to a cup 2 for another embodiment, a sewn-down part 5*b* of the first tape 5 and a sewn-down part 6*b* of the second tape 6 are both extended to the joint 2*d* along the upper and lower rims of the cup 2. These two specific embodiments concerning the extension of the first and second tapes 5, 6 are illustrated together in a single drawing (FIG. 4). It is apparent, however, the tapes should be sewn down symmetrically in actual products.

Where the first and second tapes 5, 6 are thus extended to the joints 1*d*, 2*d* of the cups 1, 2, the stretching property of the first and second tapes 5, 6 acts on the entire brassiere. As a result, the brassiere can fit the body in a more stable manner.

In the above embodiments, the joints 1*d*, 2*d* of the cups 1, 2 are constituted with the third and fourth tapes 8, 9 which are sewn to the cups in an obliquely crossed arrangement. Instead, the joints 1*d*, 2*d* of the cups 1, 2 may utilize a conventional front hook.

INDUSTRIAL APPLICABILITY

According to the ladies garment of the present invention, even when arms are moved upwardly and downwardly or otherwise, and muscles at the sides of the body moves upwardly and downwardly in this connection, such muscle movements do not cause the cups and the tapes to slide vertically off the position. Hence, the ladies garment can fit stably on a given position at each side of the body.

In addition, the stretching property of the back-side tapes and the stretching property of the breast-side tapes are balanced well and function more effectively. Because a balance of the stretching property is thus maintained at the front and the back of the body (on the breast side and the back side), the ladies garment fits the body better. The ladies garment is advantageous in these respects.

What is claimed is:

1. A ladies garment composed of left and right cups, joints for connecting the cups at a front of a wearer, and tapes which are attached to a left side part of the left cup and a right side part of the right cup and which are to be put on the wearer in such a manner as to wrap the body of the wearer from each side of the wearer and across the back of the wearer, characterized in that the tapes comprise a stretchable first tape attached to an upper rim of the left cup and a lower rim of the right cup, and a stretchable second tape attached to a lower rim of the left cup and an upper rim of the right cup, with the first tape and the second tape being arranged to cross over each other at a lateral center of the back of the wearer.

2. A ladies garment according to claim 1, characterized in that the tapes extend along the upper rim and/or the lower rim of each cup and reach the joints of the cups.

3. A ladies garment according to claim 1 or 2, characterized in that the joints of the left and right cups are connected to each other by stretchable third and fourth tapes, with the third tape and the fourth tape being arranged to cross each other at a lateral center of the wearer, between the breasts of the wearer.

* * * * *